US005366105A

United States Patent [19]

Kerman et al.

[11] Patent Number: 5,366,105

[45] Date of Patent: Nov. 22, 1994

[54] CONTAINMENT DEVICE FOR SAFELY INSPECTING, LOADING AND UNLOADING FIREARMS

[76] Inventors: Edward H. Kerman; Robert R. Crovatto, both of c/o 6270 Montrose Rd., Rockville, Md. 20852

[21] Appl. No.: 149,388

[22] Filed: Nov. 9, 1993

[51] Int. Cl.[5] ..... B65D 90/06

[52] U.S. Cl. ..... 220/453; 220/464; 220/468; 220/DIG. 21; 89/36.02

[58] Field of Search ..... 220/453, 464, 468, 470, 220/88.1, DIG. 21; 89/36.02, 1.1, 1.11

[56] References Cited

U.S. PATENT DOCUMENTS

| | | | |
|---|---|---|---|
| 4,683,688 | 8/1987 | Wojcinski | 273/404 |
| 4,694,119 | 9/1987 | Groenewegen | 220/88.1 |
| 4,750,631 | 6/1988 | Hastings et al. | 220/88.1 |
| 4,846,043 | 7/1989 | Langsam | 273/403 |
| 4,856,791 | 8/1989 | McQuade | 273/410 |
| 5,104,700 | 4/1992 | Peterson | 220/88.1 |
| 5,123,538 | 6/1992 | Groenewegen | 220/453 |

*Primary Examiner*—Gary E. Elkins
*Assistant Examiner*—S. Castellano

[57] ABSTRACT

A containment device is formed by an outer container having a curtain-covered front opening and separate removable and replaceable protective panels mounted within the container adjacent to each of the walls thereof. Each protective panel is formed of a composite of layers, including an outer energy absorbing layer closest to the container walls, an intermediate ballistic shield layer, and an inner elastomeric layer. A firearm to be inspected, loaded or unloaded is positioned with its muzzle pointing toward the curtain at the front opening of the device whereby, if the firearm accidentally discharges, the projectile will pass through the curtain, the inner elastomeric layer, and become entrapped and contained within or adjacent to the ballistic shield layer. The outer energy absorbing layer prevents damage to the wall of the container. If one of the protective panels becomes damaged or deformed, it can be individually replaced.

7 Claims, 1 Drawing Sheet

CONTAINMENT DEVICE FOR SAFELY INSPECTING, LOADING AND UNLOADING FIREARMS

This invention relates to a safety device for use in the inspecting, loading and unloading of firearms, a device sometimes known as a bullet trap.

One of the principal causes of accidental shootings, resulting in injuries or death, arises when a firearm is accidentally discharged while it is being inspected, loaded or unloaded. Law enforcement personnel, military personnel, National Guard troops, security agencies, private guard services, target-shooters, and all types of sportsmen and hunters have the need from time to time to inspect firearms, and to load live ammunition into, or unload live ammunition from, their firearms. Often this loading or unloading must take place in relatively close quarters or crowded areas where the accidental discharge of a firearm can cause the projectile to injure bystanders, either by directing hitting them or ricocheting around the surrounding area.

Recently, a substantial number of law enforcement agencies at the federal, state and local levels, as well as security and agencies, have converted from the revolver to a semi-automatic pistol, a much more mechanically complex handgun. With the advent of tactical response teams, the adoption and use of submachineguns and shotguns has become more prolific. Consequently, the problem of accidental discharges has become more acute in recent years. In addition, most projectiles fired from these weapons will pierce interior walls and many will pierce building outer walls. Thus, a law enforcement officer inspecting, loading or unloading a handgun, shotgun or submachinegun in his own office in a high rise office building not only risks injury to himself but also endangers the personnel working in surrounding offices.

Bullet traps have been used in the past in an effort to avoid such problems but the nature of their designs has been such that their use has been sparing rather than widespread. Such bullet traps were initially designed for use in ballistics testing. Such devices were typically heavy and bulky items filled with fiber or water for the purpose of catching or trapping the bullet without causing any damage to the ballistic markings thereon. While it was possible to employ such devices as safety devices for inspecting, loading and unloading of firearms, such procedure was simply not followed in practice. Such bullet traps were normally too large or too heavy to be readily used in offices, locker rooms, and all of the other areas where people customarily load and unload weapons. Moreover, such bullet traps were expensive diagnostic devices which were purchased and used for police laboratory work and therefore were not available for use on a daily basis by the numerous law enforcement personnel who might be required to inspect, load or unload their firearms at the facility where the bullet trap was located. In any event, most law enforcement officers perform their daily duties in buildings which are not equipped with any type of bullet trap.

It has been recognized in the prior art that more adaptable forms of bullet traps might be useful merely as safety devices for use in loading or unloading of weapons, rather than for catching and preserving the discharged bullet for ballistic analysis purposes. U.S. Pat. No. 4,846,043 to Stuart Langsam, issued Jul. 11, 1989, shows such a bullet trap. The device of that patent, however, closely simulated the previous ballistic analysis type of bullet traps by employing swatches of fiber material in a closed container to "catch" the bullet if one accidentally discharged from a weapon during loading or unloading. Moreover, the Langsam device contemplated either the use of a precise shaped opening through which the muzzle of the weapon had to be inserted, making it somewhat difficult to use, or a penetrable wall which would be damaged the first time a round was fired through it.

With the foregoing in mind, it is therefore an object of the present invention to overcome the deficiencies associated with known forms of bullet traps and to provide a new and improved safety device which can be used to safely inspect, load and unload firearms and to prevent injuries in the event that a firearm accidentally discharges during such activities.

It is another object of the present invention to provide a containment device for safely inspecting, loading and unloading firearms, which device is relatively lightweight, small in size, and easily portable, to assure that it can be used in a wide variety of environments.

It is another object of the present invention to provide a containment device for safely inspecting, loading and unloading firearms which is relatively inexpensive and in which individual parts thereof damaged by discharged projectiles can be readily replaced.

It is another object of the present invention to provide a containment device which can easily be used by a person engaged in the act of inspecting, loading or unloading a firearm and which does not require any special or intricate positioning of the weapon.

It is another object of the present invention to provide a highly adaptable type of safety device which can be used in a wide variety of applications where firearms must be inspected, loaded or unloaded.

It is another object of the present invention to provide a containment device which is safe for use in inspecting, loading and unloading of firearms and which prevents injury either by direct contact or by ricochet of a projectile from a firearm if the firearm is accidentally discharged.

Other objects, advantages and salient features of the present invention will become apparent from the following detailed description, which, taken in conjunction with the annexed drawings, discloses a preferred embodiment thereof.

The foregoing objectives are attained in the present invention by providing a container having a front opening into or toward which the muzzle of firearm to be inspected, loaded or unloaded is directed. A protective elastomeric curtain is hung across the front opening to reduce the likelihood of the escape of ricochets, although the possibility of injury from a ricochet is very slight, since, as will be explained, the device serves to assure that the residual velocity of a ricocheted projectile has been markedly reduced before it can return to the front elastomeric curtain of the containment device.

The container has a series of composite protective panels mounted within it adjacent to the container walls. Each protective panel is formed of three adjacent layers: an outer energy absorbing layer disposed against the walls of the container, an intermediate ballistic shield layer, and an inner elastomeric layer. The elastomeric layer reduces ricochets and slows the projectile in the event a firearm is accidentally discharged into the container. Such projectile will pierce the elastomeric layer and become lodged or entrapped within the ballistic shield layer. Any deformation of the ballistic shield layer as a result of being struck by the projectile will be absorbed by the outer energy absorbing layer to prevent the outer walls of the container from becoming damaged. The individual protective panels are separately removable and replaceable so that a damaged panel can be replaced without having to replace any other part of the device. A protective elastomeric curtain is be hung across the front opening to further reduce the likelihood of the escape of ricochets, although the possibility of injury from such a ricochet is deemed very slight, since the residual velocity of a projectile has been markedly reduced before it can return to the front elastomeric curtain of the containment device.

Referring now to the drawings.

Figure 1:
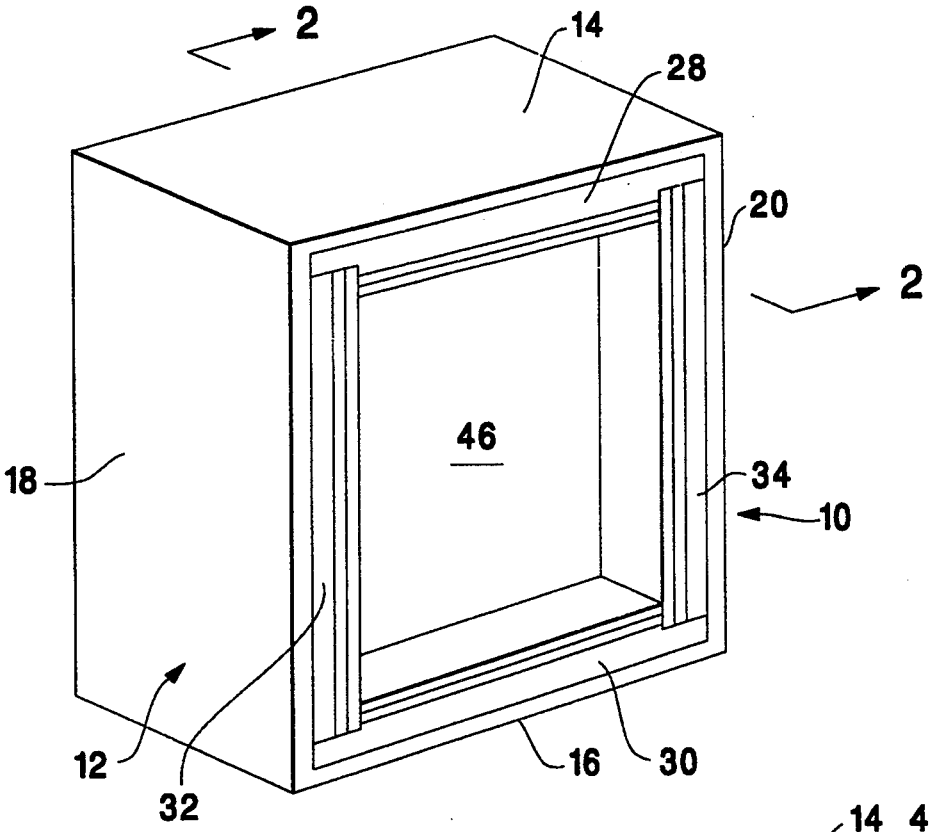
FIG. 1 is a perspective view of the device of the present invention.

Referring now to the drawings in further detail, a containment device generally designated 10 in accordance with the present invention is shown. The device 10 includes an outer container generally designated 12 which is actually an open-fronted container formed by a top wall 14, a bottom or base wall 16, a pair of opposed side walls 18 and 20, and a rear wall 22.

Figure 2:
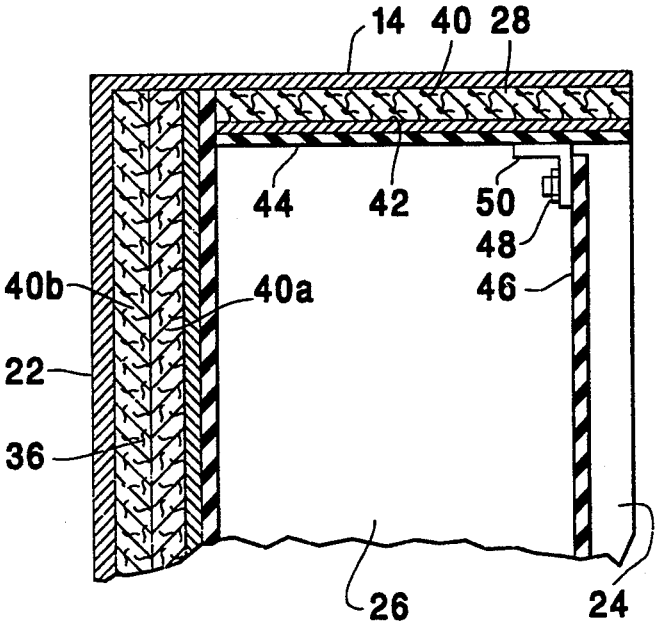
FIG. 2 is a fragmentary sectional view of the device along the lines 2—2 of FIG. 1.

The container 12 is advantageously fabricated of steel plane. The rear wall 22 is of a thickness double that of the other walls, as shown in FIG. 2, since the chances are very strong that if a weapon is accidentally discharged within the container 12, the projectile will be directed toward the rear wall 22. The double thickness of the rear wall is therefore an added safety feature of the invention.

The container has a front opening 24 which leads into an internal chamber 26 within the container, as circumscribed and defined by the container walls.

There are five separate protective panels positioned within the chamber 26, in contact against each of the five walls of the chamber. The top protective panel 28 abuts against the top wall 14 and the bottom protective panel 30 abuts against the bottom wall 16. The side protective panels 32 and 34 abut respectively against the container side walls 18 and 20. Finally, the rear protective panel 36 abuts against the rear container wall 22.

Each of the protective panels is separately insertable into and removable from the container chamber 26. The rear panel 36 extends for the full height and width of the interior of the rear wall 22. The top panel 28 and bottom panel 30 abut at their inner ends against the rear panel 36 in the manner shown in FIG. 2. The side edges of the top and bottom panels 28 and 30 are notched away, as shown in FIG. 1, by a distance equal to the thickness of the side panels 32 and 34, and the thickness of the elastomeric and intermediate ballistic shield layers, which will be described hereinafter. This permits the side panels to be slid into the container chamber 26 and held in position therewithin by engagement of their upper edges with the notches at the side edges of the top panel 28 and at their lower ends by engagement of their lower edges with the notches at the side edges of the bottom panel 30.

Each of the protective panels is formed of a composite of three juxtaposed layers, namely, an energy absorbing layer adjacent to and in contact with the container walls, an intermediate ballistic shield layer, and an inner elastomeric layer. The energy absorbing layer 40 is advantageously fabricated of plywood or particle board. It has the capability of absorbing blunt trauma generated when a discharged projectile strikes the panel in order to prevent damage to the adjacent container wall. The intermediate ballistic shield layer 42 is fabricated of Spectraboard or other known forms of ballistic armor such as Kelvar. This layer has the capability of stopping a projectile which contacts against it. That is, the layer 42 is incapable of being pierced by a projectile fired from a firearm while the same is being inspected, loaded or unloaded using the device 10 of the present invention.

As used herein, the term "firearm" includes handguns, rifles, submachineguns and shotguns, all of which can be inspected, loaded or unloaded safely through use of the present invention by assuring that the weapon muzzle is directed into the opening 24 of the device 10.

The inner layer 44 of the protective panels is fabricated of an elastomeric material which, when pierced by a projectile, prevents the projectile from ricocheting back away from the ballistic layer 42. Advantageously, the inner layer 44 is fabricated of Linatex, a natural rubber material. U.S. Pat. No. 4,856,791 issued to J. O. McQuade on Aug. 15, 1989 discloses the use of such material to prevent ricochets of projectiles in a firing range environment. The inner layer 44 is bonded to the intermediate layer 42.

As an additional safety feature of the device 10, a curtain 46 of elastomeric material, like that of the inner layer 44, is hung within the device 10 spaced slightly inwardly from the front opening 24. The curtain 46 is suspended from the top protective panel 28 by being connected by screw fasteners 48 to an angle bracket 50 which is affixed to the inner surface 44 of the top protective panel by screw fasteners, not shown, which screw into the plywood of layer 40 of the panel 28. The curtain 46 is intended as an additional protection to prevent ricochets from escaping out of the device 10.

It can also be seen from FIG. 2 that the energy absorbing layer of the rear protective panel 36 is of double thickness, formed of superimposed layers 40*a* and 40*b*. This is again a safety feature to prevent damage to the rear container wall 22, recognizing that most projectiles discharged into the device will be directed toward the rear wall thereof.

In use, the person desiring to inspect, load or unload a firearm will orient the firearm so the muzzle thereof points into or through the front opening 24 of the device. The muzzle should be placed against the curtain 46. The inspection of the firearm, or the loading of ammunition into or the unloading of ammunition gun of the firearm, can then proceed safely. If during the course of such inspection, loading or unloading, the firearm is accidentally fired, the discharged projectile will pass through the front curtain 46 and through the inner chamber 26 until it strikes against one of the protective panels. As previously indicated, the panel which would normally be struck by the projectile is the rear panel since the muzzle would normally be directed toward that panel. However, the safety device 10 of the present invention is designed to provide safety regardless of whether the accidentally fired projectile contacts the top, the bottom, the side, or the rear protective panel.

Figure 3:
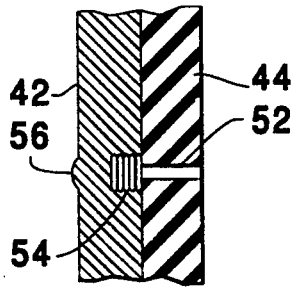
FIG. 3 is a fragmentary perspective view of the inner and intermediate layers of the protective panels with a projectile lodged within the intermediate panel.

When a fired projectile contacts against the inner elastomeric layer 44 of a protective panel and pierces that layer, it causes an opening 52, as shown in FIG. 3, which normally closes after the projectile passes thorough the layer. The projectile, designated 54 in FIG. 3, then contacts against the ballistic shield layer 42 of the protective panel. Since the projectile cannot pierce this layer, it instead flattens against the shield layer and is retained there by the elastomeric layer 44. In other words, the discharged projectile ends up being entrapped in and contained within the protective panel. The force of the projectile contacting against the ballistic shield panel may well cause a deformation 56 of that panel. This deformation 56 is absorbed by the adjacent energy absorbing layer 40 to assure that, regardless of the impact force of the projectile against the ballistic shield layer, any deformation of that layer will be absorbed by the energy absorbing layer 40 and will not cause deformation or penetration of the walls of the container 12.

A device in accordance with the present invention has been built and tested satisfactorily. That test device was approximately 13 inches wide and deep and approximately 19 inches high. All of the container walls except the rear wall were fabricated of $\frac{1}{8}$ inch sheet steel. The rear wall was fabricated of $\frac{1}{4}$ inch sheet steel. The inner elastomeric layer and the intermediate ballistic shield layer were each $\frac{1}{4}$ inch in thickness and the energy absorbing layer on all but the rear protective panel was $\frac{3}{4}$ inches in thickness. On the rear protective panel, the energy absorbing layers 40*a* and 40*b* were each $\frac{3}{4}$ inches in thickness. The curtain 46 was also $\frac{1}{4}$ inch in thickness. The device weighed approximately 77 pounds. Numerous test firings were discharged into this nest device, using handguns, submachineguns and shotguns, with different types of ammunition. In every instance, the energy or blunt trauma caused by the contact of the projectile against the ballistic shield layer was fully absorbed by the energy absorbing layer. In no instance was there any damage to the steel walls of the container.

It will, of course, be understood that the protective panels are individually removable and replaceable. Therefore, after significant damage has been caused to a particular panel, that panel can be separately replaced and the device will be as functional as it was originally.

Various other modifications or features apparent to those skilled in the art may be added without departing from the spirit or scope of the invention as defined in the appended claims. For example, rubber feet may be applied to the bottom of the device to make it skidproof in case it is to be placed on a desk or a table. A carrying handle may be added to enable the device to be readily transported from one location to another. And, of course, the shapes, sizes, dimensions or materials of the device may be modified as necessary or desirable to accomplish the results required. For example, for use with rifles, which may have increased muzzle velocity and/or projectile weight, a larger and heavier form of the device may be required. Other such changes, modifications or additions may be employed without departing from the spirit and scope of the invention as defined in the appended claims.

What is claimed is:

1. A portable containment device for safely inspecting, loading and unloading firearms, comprising:

an outer container having a size and weight which enables it to be manually transported from one location to another;

said outer container having a rear wall, opposed top and bottom walls, opposed side walls, and a front opening, all of which circumscribe and define a container interior;

a plurality of separate composite protective panels, each composed of:

an elastomeric ricochet prevention layer;

a ballistic shield layer adjacent to the elastomeric ricochet prevention layer; and an energy absorbing layer adjacent to the ballistic shield layer;

five of said protective panels being removably disposed within said outer container, with one of said panels being disposed adjacent to said container rear wall, two of said protective panels being disposed adjacent to said side walls, and the remaining two protective panels being disposed adjacent to said top and bottom walls;

each of said protective panels being positioned within said outer container with the energy absorbing layer adjacent to the outer container wall and the elastomeric ricochet prevention layer being disposed toward said interior of the outer container;

said device being adapted for insertion of the muzzle of a firearm through the front opening and into the interior of the outer container during loading, unloading, and inspection of the firearm;

said elastomeric ricochet prevention layer being penetrable by a projectile discharged from the firearm and capable of preventing the projectile from ricocheting out of the interior of the outer container;

said ballistic shield layer being impenetrable by a projectile discharged from the firearm;

said energy absorbing layer being capable of absorbing the impact of a projectile which strikes the ballistic shield layer to prevent any deformation of the walls of the outer container; and said protective panels being individually removable from said outer container to permit any of said panels to be replaced in the event that such panels have become damaged from repeated projectile discharges against them.

2. A containment device as defined in claim 1 wherein the energy absorbing outer layer of the protective panel adjacent to the rear wall of the outer container is approximately double the thickness of the energy absorbing outer layers of the remaining protective panels.

3. A containment device as defined in claim 1 further including an elastomeric curtain suspended from the protective panel adjacent to said top wall and hanging across said front opening.

4. A containment device as defined in claim 2 wherein on all of said protective panels except the one adjacent to the rear wall of the outer container, the intermediate ballistic shield layer and the inner elastomeric layer are of approximately equal thickness and the outer energy absorbing layer is approximately triple that thickness.

5. A containment device as defined in claim 4 wherein on nine protective panel adjacent to the rear wall of the outer container, the intermediate ballistic shield layer and the inner elastomeric layer are of approximately equal thickness and the ouster energy absorbing layer is approximately six times that thickness.

6. A containment device as defined in claim 1 wherein the outer container walls are fabricated of steel and wherein the thickness of the rear wall is approximately double the thickness of the other walls.

7. A containment device as defined in claim 6 wherein the outer energy absorbing layers of the protective panels are fabricated of plywood or particle board.

* * * * *